US012331487B2

(12) United States Patent
Park

(10) Patent No.: US 12,331,487 B2
(45) Date of Patent: Jun. 17, 2025

(54) DEVICE FOR CONTROLLING WORKING UNIT OF CONSTRUCTION EQUIPMENT

(71) Applicant: VOLVO CONSTRUCTION EQUIPMENT AB, Eskilstuna (SE)

(72) Inventor: Do Sang Park, Gyeongsangnam-do (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 636 days.

(21) Appl. No.: 17/282,235

(22) PCT Filed: Oct. 2, 2018

(86) PCT No.: PCT/KR2018/011703
§ 371 (c)(1),
(2) Date: Apr. 1, 2021

(87) PCT Pub. No.: WO2020/071567
PCT Pub. Date: Apr. 9, 2020

(65) Prior Publication Data

US 2021/0348365 A1 Nov. 11, 2021

(51) Int. Cl.
*E02F 9/22* (2006.01)
*E02F 9/20* (2006.01)
*E02F 9/26* (2006.01)

(52) U.S. Cl.
CPC ..... *E02F 9/2203* (2013.01); *E02F 9/2004* (2013.01); *E02F 9/267* (2013.01)

(58) Field of Classification Search
None
See application file for complete search history.

(56) References Cited

U.S. PATENT DOCUMENTS 5,005,466 A * 4/1991 Miyaoka ..... E02F 9/2203 91/461
7,283,903 B2 * 10/2007 Merten ..... E02F 9/166 307/10.6

(Continued)

FOREIGN PATENT DOCUMENTS

CN 101922489 A 12/2010
EP 2251299 A1 11/2010

(Continued)

OTHER PUBLICATIONS

International Search Report and Written Opinion dated Jul. 2, 2019 in corresponding International PCT Application No. PCT/KR2018/011703, 8 pages.

(Continued)

*Primary Examiner* — Angela Y Ortiz
*Assistant Examiner* — Torrence S Marunda, II
(74) *Attorney, Agent, or Firm* — Venable LLP; Jeffri A. Kaminski

(57) ABSTRACT

Provided is a device for controlling a working unit of construction equipment which comprises a hydraulic control device configured to hydraulically control a working unit and operated by an operating lever, a plurality of sub-electronic control units (ECU) electrically connected with the hydraulic control device, a main ECU configured to receive information on states of the hydraulic control device and the plurality of sub-ECUs, a relay configured to apply or cut off electric power to the plurality of sub-ECUs by a signal generated from the main ECU, and an emergency mode switch configured to turn an emergency mode on/off, wherein, when the emergency mode switch is turned on, the relay to which electric power is cut off according to a main ECU's failure diagnosis signal applies or cuts off electric (Continued)

power to the plurality of sub-ECUs by movement of the operating lever.

7 Claims, 2 Drawing Sheets

(56) References Cited

U.S. PATENT DOCUMENTS

| | | | | |
|---|---|---|---|---|
| 8,544,263 | B2 | 10/2013 | Kim | |
| 8,621,855 | B2 * | 1/2014 | Meyeres | E02F 9/2004 60/484 |
| 9,230,761 | B2 | 1/2016 | Kim et al. | |
| 9,284,719 | B2 * | 3/2016 | Lim | E02F 9/2292 |
| 10,041,225 | B2 * | 8/2018 | Mizuochi | E02F 9/2004 |
| 10,983,539 | B2 * | 4/2021 | Tsuchie | G05D 16/08 |
| 11,198,352 | B2 * | 12/2021 | Naya | B60K 6/485 |
| 2010/0313556 | A1 | 12/2010 | Kim | |
| 2013/0119784 | A1 | 5/2013 | Kim et al. | |
| 2013/0312403 | A1 | 11/2013 | Lim et al. | |

FOREIGN PATENT DOCUMENTS

| | | | |
|---|---|---|---|
| EP | 2270617 | A2 | 1/2011 |
| EP | 2597212 | A1 | 5/2013 |
| EP | 2669529 | A2 | 12/2013 |
| JP | H0732848 | A | 2/1995 |
| JP | H07109097 | A | 4/1995 |
| JP | H1037905 | A | 2/1998 |
| JP | 2005264605 | A | 9/2005 |
| JP | 2005273894 | A | 10/2005 |
| JP | 2006104836 | A | 4/2006 |
| KR | 20100134332 | A | 12/2010 |
| KR | 20110073888 | A | 6/2011 |

OTHER PUBLICATIONS

Chinese Office Action dated May 2, 2022 in corresponding Chinese Patent Application No. 201880098247.8, 6 pages.

European Search Report dated Apr. 21, 2022 in corresponding European Patent Application No. 18936250.2, 5 pages.

* cited by examiner

[Fig. 1]
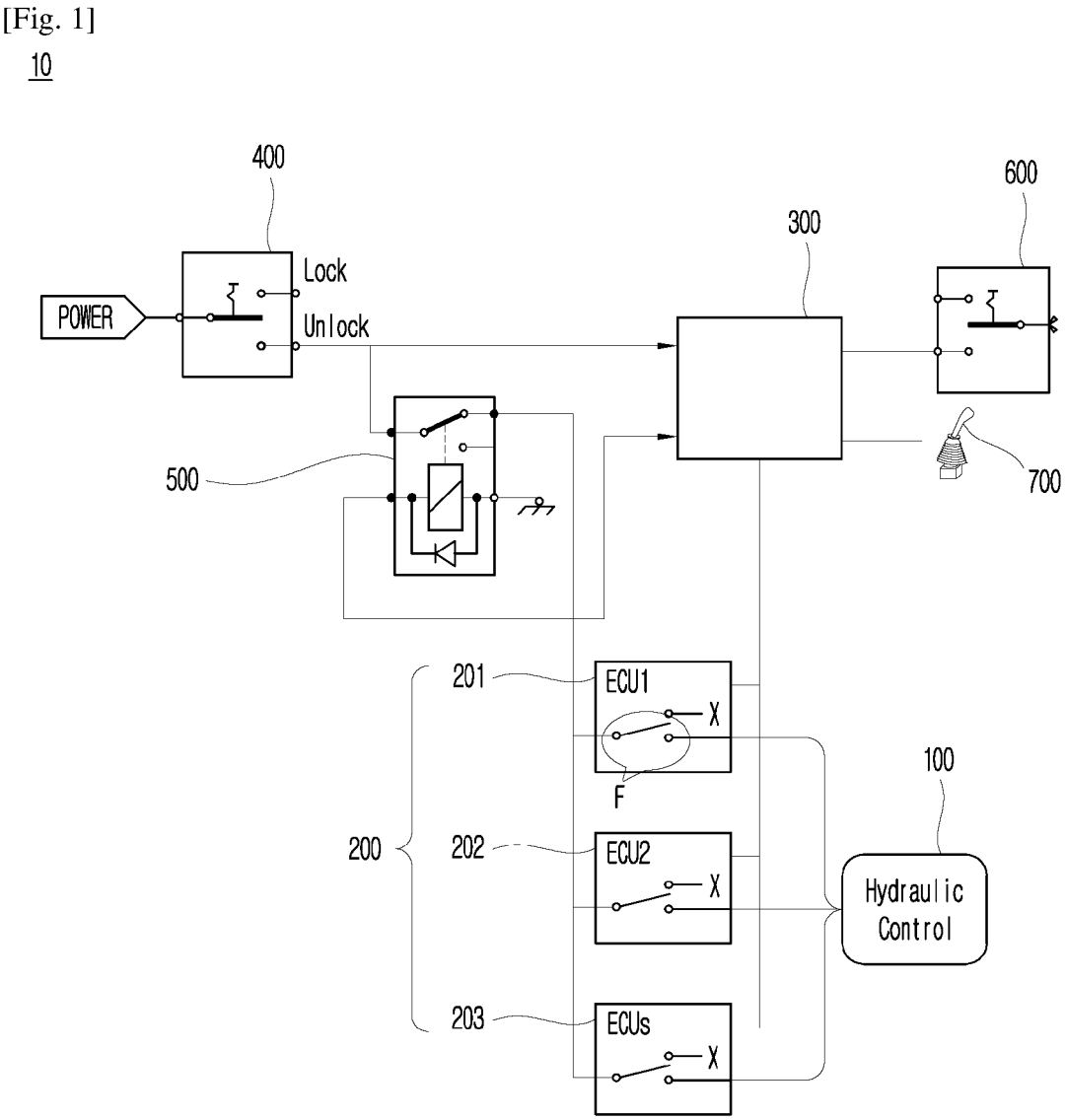
[Fig. 2]
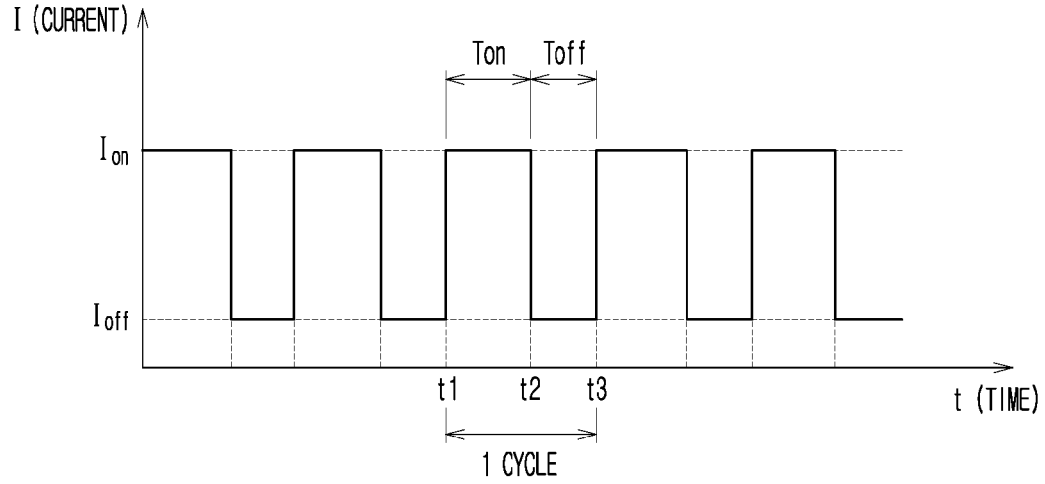

[Fig. 3]
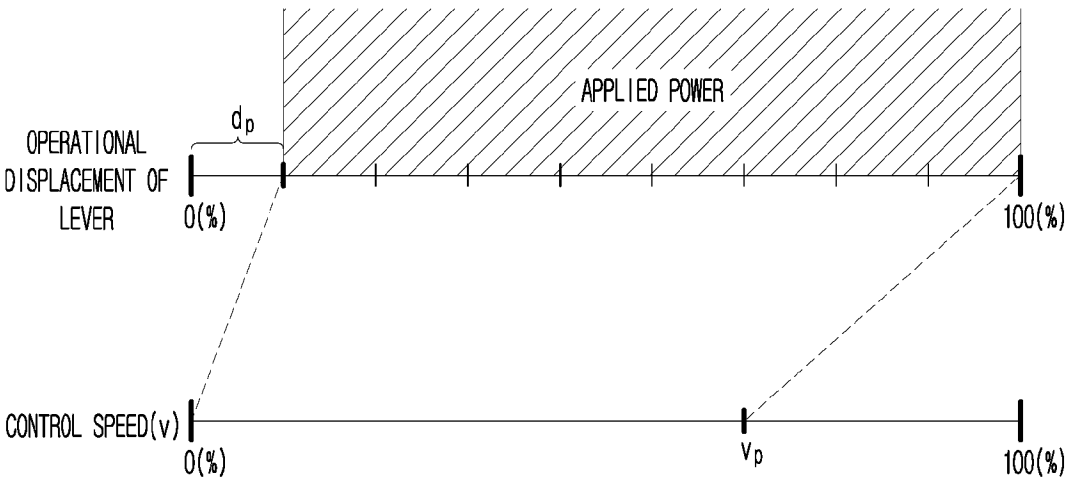

DEVICE FOR CONTROLLING WORKING UNIT OF CONSTRUCTION EQUIPMENT

CROSS-REFERENCE TO RELATED APPLICATIONS

This application is a U.S. National Stage application of PCT/KR2018/011703, filed Oct. 2, 2018, and published on Apr. 9, 2020, as WO 2020/071567 A1, all of which is hereby incorporated by reference in its entirety.

TECHNICAL FIELD

The present invention relates to a device for controlling a working unit of construction equipment, and more specifically, to a device for controlling a working unit of construction equipment which allows operation of a working unit to be thoroughly controlled when failure of construction equipment is diagnosed.

BACKGROUND ART

According to the conventional art, when failure of a device for controlling a working unit of construction equipment, which is being operated, is diagnosed, hydraulic control of all working units is stopped, and thus the equipment is stopped.

When hydraulic control is fully stopped due to the failure, operation of any equipment is not possible.

Particularly, when the equipment is stopped due to failure caused while the working unit is in ascended state, the working unit should be lowered for safe repair.

However, control is not possible because hydraulic control is fully stopped.

In this case, the working unit may be lowered with electric power forcibly applied to the hydraulic control device, however, the working unit may be damaged due to collision with the ground while falling free, and an accident may occur.

Therefore, a function of slowly controlling the equipment according to a user's needs or need of repair when failure of the device for controlling a working unit is diagnosed is required.

(Patent Document 01) Japanese Patent Application Laid-Open No. H07-109097 (Published on Apr. 25, 1995)

DISCLOSURE OF INVENTION

Technical Problem

The present invention is directed to providing a device for controlling working unit of construction equipment which allows a working unit to be slowly lowered even when the working unit, such as a boom or the like, is stopped due to failure of the construction equipment in an ascending state.

Solution to Problem

Accordingly, provided is a device for controlling a working unit of construction equipment which comprises a hydraulic control device configured to hydraulically control a working unit and operated by an operating lever, a plurality of sub-electronic control units (ECU) electrically connected with the hydraulic control device, a main ECU configured to receive information on states of the hydraulic control device and the plurality of sub-ECUs, a relay configured to apply or cut off electric power to the plurality of sub-ECUs by a signal generated from the main ECU, and an emergency mode switch configured to turn an emergency mode on/off, wherein, when the emergency mode switch is turned on, the relay to which electric power is cut off according to a main ECU's failure diagnosis signal applies or cuts off electric power to the plurality of sub-ECUs by movement of the operating lever.

The main ECU may determine whether the hydraulic control device malfunctions according to a state information measurement value of the hydraulic control device measured by the sub-ECU.

The emergency mode switch may be connected to the relay through the main ECU.

The main ECU may control repeated turning on/off of the relay according to an on-signal of the emergency mode switch.

The turning on/off of the relay may control the hydraulic control device with a control speed calculated based on the following Equation 1:

$$v=T_{on}/(T_{on}+T_{off})\times 100 \quad \text{[Equation 1]}$$

(v represents control speed, $T_{on}$ represents time for which current $I_{on}$ is applied within one cycle including $T_{on}+T_{off}$, and $T_{off}$ represents time for which the relay is turned off).

The control speed may be controlled to be less than or equal to a predetermined value ($v_p$).

The predetermined value ($v_p$) may be 60%.

The emergency mode switch may perform turning on/off of the relay when operational displacement at a neutral position of the operating lever is greater than or equal to a predetermined range ($d_p$).

The predetermined range ($d_p$) of the operational displacement of the operating lever may be 10%.

Advantageous Effects of Invention

Therefore, when failure of construction equipment is diagnosed, operation of a working unit is thoroughly controlled such that the working unit is slowly lowering, and thus an accident can be prevented.

It should be understood that the effects of the present invention are not limited to the aforementioned effects, and include all of the effects deducible from the detailed description of the present invention or the configuration of the invention described in the claims.

BRIEF DESCRIPTION OF DRAWINGS

The above and other objects, features and advantages of the present invention will become more apparent to those of ordinary skill in the art by describing exemplary embodiments thereof in detail with reference to the accompanying drawings, in which:

FIG. 1 schematically illustrates a device for controlling a working unit of construction equipment according to an embodiment of the present invention;

FIG. 2 is a graph illustrating a speed control of the device for controlling a working unit of construction equipment according the embodiment of the present invention; and FIG. 3 is a schematic view illustrating electric power to be applied according to operational displacement of a lever.

MODE FOR THE INVENTION

Hereinafter, embodiments will be described with reference to the accompanying drawings. However, the embodiments of the present invention may be implemented in several different forms and are not limited to the embodiments described herein. In addition, parts irrelevant to description will be omitted in the drawings to clearly explain the embodiments of the present invention, and similar parts are denoted by similar reference numerals throughout this specification.

Throughout the specification, when an element is referred to as being "connected" to another element, the element may be "directly connected" to another element or the element may be "indirectly connected" to another element through an intervening element. Further, when a portion "comprises" an element, the portion may comprise the element and another element may be further included therein, unless otherwise described.

FIG. 1 schematically illustrates a device for controlling a working unit of construction equipment according to an embodiment of the present invention.

As shown in FIG. 1, the device for controlling a working unit of construction equipment according to the embodiment of the present invention may comprise a hydraulic control device 100, a sub-electronic control unit (ECU) 200, a main ECU 300, a safety lever switch 400, and a relay 500.

In the embodiment, the working unit may refer to a boom, an arm, a bucket, a swing, a driving unit, or the like, which are not shown, and the hydraulic control device 100 may refer to a boom cylinder for controlling upward and downward movements of the boom of the working unit, an arm cylinder for controlling upward and downward movements of the arm, a bucket cylinder for hydraulically controlling the bucket, or a swing valve for controlling rotation of the swing.

Although FIG. 1 illustrates one hydraulic control device 100, a plurality of hydraulic control devices 100 may be applied thereto.

The sub-ECU 200 may comprise a plurality of ECUs 201, 202, and 203 and may be electrically connected with the hydraulic control device 100 to control each of the hydraulic control devices 100.

Each of the sub-ECUs 200 is electrically connected to each of the hydraulic control devices 100 to control opening or closing of a passage of each of the hydraulic control devices 100.

Further, the sub-ECU 200 measures information on a state of each of the hydraulic control devices 100 in real time and determines whether anyone of the hydraulic control devices 100 malfunctions based on the measured state information.

The main ECU 300 may be configured to control electric power to be applied to or cut off from the relay 500.

In this case, the main ECU 300 receives a state information measurement value of one of the hydraulic control devices 100 detected by the sub-ECU 200, and may cut off the electric power to the relay 500 when the main ECU 300 receives a malfunction signal from the hydraulic control device 100.

The safety lever switch 400 is manually operated by a user, but when the safety lever switch 400 is in an unlocked state, electric power is supplied to all of the hydraulic control devices 100 such that hydraulic control is performed, and when the safety lever switch 400 is switched to a locked state, a function of blocking hydraulic control of all of the hydraulic control devices 100 is performed.

In this case, when failure of any one of the hydraulic control devices 100 is diagnosed by the sub-ECU 200, an emergency mode switch 600 may be configured to repeatedly turn the relay 500 on/off even when the safety lever switch 400 is in the unlocked state.

The emergency mode switch 600 may be configured to forcibly apply electric power to the relay 500, and in this case, the relay 500 is repeatedly controlled to be turned on/off by an operating lever 700, and the hydraulic control devices 100 may be controlled at a control speed calculated based on the following Equation 1.

$$v=T_{on}/(T_{on}+T_{off})\times 100 \quad \text{[Equation 1]}$$

In this equation, v represents control speed, $T_{on}$ represents time for which current $I_{on}$ is applied within one cycle including $T_{on}$ and $T_{off}$, and $T_{off}$ represents time for which the relay 500 is turned off.

The control speed v does not represent an exact physical speed. In other words, the control speed v represents a percentage ratio (%) for the control speed when the construction equipment is in a normal state.

Meanwhile, FIG. 2 is a graph illustrating a speed control of a hydraulic circuit of the construction equipment. Referring to FIGS. 1 and 2, $I_{on}$ may represent a current value generally applied to the relay 500 when the construction equipment is in a normal state, and $I_{off}$ may represent a current value in a state in which a current applied to the relay 500 is cut off.

Further, $T_{on}$ equals $t_2$ minus $t_1$, $T_{off}$ equals $t_3$ minus $t_2$, and the sum of $T_{on}$ and $T_{off}$ is defined as one cycle.

Generally, $T_{on}+T_{off}$, which is one cycle, may approximately be 300 ms in a general case but may be various values according to various combinations of $T_{on}$ and $T_{off}$.

Meanwhile, when the emergency mode switch 600 is turned on, equipment may be forcibly and slowly operated regardless of whether the equipment malfunctions.

That is, when the main ECU 300 allows an on-off waveform to be repeated as shown in FIG. 2, the electric power is repeatedly applied to and cut off from the hydraulic control devices 100, and all valves of the equipment move regularly in an intermittent manner, and thus the working unit moves slowly.

As shown in FIG. 1, $T_{on}$ and $T_{off}$ are controlled in proportion to operational displacement of the operating lever 700, and thus a speed of the working unit, such as the boom, the arm, the bucket, the swing, the driving unit, or the like, can be controlled.

The control speed v is determined based on Equation 1.

The control speed v may be set to be less than or equal to a predetermined value $v_p$, and preferably, the predetermined value $v_p$ may be set to 60%.

When the maximum value of the control speed v is set to be less than or equal to 60%, the control speed v is controlled to be less than or equal to 60% even when the operating lever 700 is controlled to the maximum displacement by unskilled operation of a user.

Further, referring to FIG. 3, when operational displacement of the operating lever 700 is zero at a neutral position, electric power is cut off so that the equipment is not operating, and when the operational displacement of the operating lever 700 is in a range from zero to 100%, electric power starts to be applied when the operating lever 700 is pulled with the operational displacement in a predetermined range $d_p$ or higher.

In this case, it may be preferable that the predetermined range $d_p$ of the operational displacement of the operating lever 700 at which the power starts to be applied is set to 10%.

Further, $T_{on}$ increases according to the operational displacement of the operating lever 700, and as the operational displacement increases, the time for controlling the working unit increases, and thus the speed increases.

Therefore, since the equipment should move slowly even when the operating lever 700 is pulled to the maximum limit of 100%, a ratio of $T_{on}$ to the entire control time should not be greater than 60%.

In this case, an upper value of a ratio of $T_{on}$ to the total control time according to the operational displacement of the operating lever 700 may vary according to a design value such as a weight of construction equipment and the like.

The device for controlling a working unit of a construction equipment is configured to thoroughly control the working unit to be slowly lowered when failure of the construction equipment is diagnosed even when the working unit, such as a boom or the like, is stopped in an ascending state, thereby preventing damage and an accident caused by the free fall of a working unit.

The above description is only exemplary, and it should be understood by those skilled in the art that the present invention may be performed in other concrete forms without changing the technological scope and essential features. Therefore, the above-described embodiments should be considered as only examples in all aspects and not for purposes of limitation. For example, each component described as a single type may be realized in a distributed manner, and similarly, components that are described as being distributed may be realized in a coupled manner.

The scope of the present invention is defined not by the detailed description but by the claims, and encompasses all modifications or alterations derived from meanings, the scope and equivalents of the claims.

DESCRIPTION OF SYMBOLS

10: WORKING UNIT CONTROL DEVICE
100: HYDRAULIC CONTROL DEVICE
200: SUB-ECU
300: MAIN ECU
400: SAFETY LEVER SWITCH
500: RELAY
600: EMERGENCY MODE SWITCH
700: OPERATING LEVER
$T_{ON}$: TIME FOR WHICH CURRENT IS APPLIED
$T_{OFF}$: TIME FOR WHICH CURRENT IS CUT OFF

The invention claimed is:

1. A device for controlling a working unit of construction equipment, the device comprising:

a hydraulic control device configured to hydraulically control a working unit and operated by an operating lever;

a plurality of sub-electronic control units (ECU) electrically connected with the hydraulic control device;

a main ECU configured to receive information on states of the hydraulic control device and the plurality of sub-ECUs;

a relay configured to apply or cut off electric power to the plurality of sub-ECUs by a signal generated from the main ECU; and an emergency mode switch configured to turn an emergency mode on/off, wherein when the emergency mode switch is turned on, the relay to which electric power is cut off according to a main ECU's failure diagnosis signal applies or cuts off electric power to the plurality of sub-ECUs by movement of the operating lever, wherein the main ECU determines whether the hydraulic control device malfunctions according to a state information measurement value of the hydraulic control device measured by the sub-ECU, wherein the main ECU controls repeated turning on/off of the relay according to an on-signal of the emergency mode switch to allow the working unit to be moved in an intermittent manner even when the working unit is stopped due to failure of the construction equipment in an ascending state.

2. The device of claim 1, wherein the emergency mode switch is connected to the relay through the main ECU.

3. The device of claim 1, wherein the turning on/off of the relay controls the hydraulic control device with a control speed calculated based on the following Equation 1:

$$v=T_{on}/(T_{on}+T_{off})\times 100 \quad \text{[Equation 1]}$$

(v represents control speed, $T_{on}$ represents time for which current $I_{on}$ is applied within one cycle including $T_{on}+T_{off}$, and $T_{off}$ represents time for which the relay is turned off).

4. The device of claim 3, wherein the control speed is controlled to be less than or equal to a predetermined value ($v_p$).

5. The device of claim 4, wherein the predetermined value ($v_p$) is 60%.

6. The device of claim 1, wherein the emergency mode switch performs turning on/off of the relay when operational displacement at a neutral position of the operating lever is greater than or equal to a predetermined range ($d_p$).

7. The device of claim 6, wherein the predetermined range ($d_p$) of the operational displacement of the operating lever is 10%.

* * * * *